US005323923A

United States Patent [19]

Schauer

[11] Patent Number: 5,323,923

[45] Date of Patent: Jun. 28, 1994

[54] WASTE CONTAINER

[76] Inventor: Charles D. Schauer, 5590 - 10th St. South, St. Petersburg, Fla. 33705

[21] Appl. No.: 931,002

[22] Filed: Aug. 17, 1992

[51] Int. Cl.[5] ..... B65D 43/14

[52] U.S. Cl. ..... 220/337; 220/335; 220/756; 220/769; 220/771; 220/908

[58] Field of Search ..... 220/335, 337, 338, 672, 220/756, 769, 771, 908, 909

[56] References Cited

U.S. PATENT DOCUMENTS

Re. 31,086 11/1982 Johnson, Jr. et al. .
39,554 8/1963 Davis .
D. 197,007 12/1963 Brighton .
D. 202,616 10/1965 Larson .
D. 205,319 7/1966 Klein .
D. 207,578 5/1967 Zeilstra .
D. 212,551 10/1968 Shutt .
D. 214,644 7/1969 Maris .
D. 215,617 10/1969 Heck .
D. 217,498 5/1970 Dilyard .
D. 218,359 8/1970 Marsh .
D. 226,628 4/1973 Shannon .
D. 228,411 9/1973 Miller .
D. 231,184 4/1974 Brown et al. .
D. 233,125 10/1974 Hawk .
D. 246,566 12/1977 Skiver .
D. 247,087 1/1978 Dickinson .
D. 249,115 8/1978 Waldron .
D. 250,744 1/1979 Moris .
D. 253,932 1/1980 Mockler .
D. 255,762 7/1980 Lee .
D. 255,865 7/1980 Hartman .
D. 256,423 8/1980 Bacskay .
D. 256,682 9/1980 Lee .
D. 257,500 11/1980 Larius .
D. 259,763 7/1981 Dickinson .
D. 260,751 9/1981 Lee .
D. 263,017 2/1982 Douglas .
D. 263,273 3/1982 Douglas .
D. 268,059 2/1983 Kracke .
D. 269,643 7/1983 Hartman .
D. 270,200 8/1983 Creske .
D. 270,675 9/1983 Parker .
D. 270,676 9/1983 Pease .
D. 271,247 11/1983 Greensboro .
D. 271,818 12/1983 Hartman .
D. 271,848 12/1983 Tcherneshoff .
D. 276,932 12/1984 Parker .
D. 277,898 3/1985 Paul .
D. 279,616 7/1985 Deacon .
D. 280,459 9/1985 McClelland .
D. 280,856 10/1985 Michelson .
D. 281,111 10/1985 McClelland .
D. 281,284 11/1985 Reuter .
D. 291,738 9/1987 Orlowski .
D. 291,739 9/1987 Orlowski .
D. 292,638 11/1987 Carville .
D. 293,268 12/1987 Dewing .
D. 296,488 6/1988 Nelson .
D. 298,303 11/1988 Lee .
D. 302,884 8/1989 Poisat .
D. 304,631 11/1989 McCarville .
D. 308,273 5/1990 Hanna .
D. 308,742 6/1990 Bulkens .
D. 309,208 7/1990 Cajigas .
D. 309,810 8/1990 Moore .
D. 311,982 11/1990 Ladney .
D. 312,160 11/1990 Calvi .
D. 312,519 11/1990 Hobson .
307,235 10/1884 Slevin .
1,014,475 1/1912 Holloway .
1,019,198 3/1912 Spears .

(List continued on next page.)

*Primary Examiner*—Allan N. Shoap
*Assistant Examiner*—Nova Stucker
*Attorney, Agent, or Firm*—Frijouf, Rust & Pyle

[57] ABSTRACT

An improved waste container is disclosed comprising a container body having a bottom and a sidewall defining an opening in the container body. The container body has a first and a second handle support for supporting a handle. A first and a second aperture is defined in the first and second handle supports. A container lid has a first and a second lid support with a first and a second pin extending therefrom. The first and second apertures receive the first and second pins for pivotally connecting the container lid to the container body. A barrier comprising the handle and the lid supports limits the pivotal movement of the container lid.

23 Claims, 7 Drawing Sheets

U.S. PATENT DOCUMENTS 1,170,797 2/1916 Burroughs .
1,492,675 5/1924 Clark et al. .
1,643,897 9/1927 Mulhern .
1,647,829 11/1927 Holzmann .
1,715,364 6/1929 Hirschner .
1,763,756 6/1930 Casapollo .
1,891,651 12/1932 Padelford et al. .
2,205,969 6/1940 Boenecke .
2,417,696 3/1947 Linde .
2,744,710 5/1956 Gerosa .
2,762,076 9/1956 Kiba .
2,881,007 4/1959 Karwatt et al. .
3,212,125 10/1965 Hussell .
3,229,846 1/1966 Katz .
3,286,960 11/1966 Naab .
3,422,988 1/1969 Franca .
3,702,662 11/1972 Davieau .
3,704,798 12/1972 Carpenture, Jr. .
3,756,494 9/1973 Becker, Jr. et al. .
3,797,692 3/1974 Santoni .
3,800,973 4/1974 Weaver .
3,804,277 4/1974 Brown et al. .
3,850,335 11/1974 Kreutzweiser .
3,860,141 1/1975 Hawk .
3,894,642 7/1975 Shive .
3,900,106 8/1975 Cantales .
3,938,687 2/1976 Naier et al. .
3,940,011 2/1976 Dubois et al. .
3,949,877 4/1976 Santoni .
3,955,705 5/1976 Dubois et al. .
3,975,860 8/1976 Harned et al. .
3,995,764 12/1976 Zagami .
4,005,800 2/1977 Schurman .
4,033,454 7/1977 Santoni .
4,057,156 11/1977 Thompson et al. .
4,091,961 5/1978 Dubois et al. .
4,101,156 7/1978 Santoni .
4,119,240 10/1978 Dumas et al. .
4,134,609 1/1979 Santoni .
4,135,657 1/1979 Benson et al. .
4,136,796 1/1979 Dubois et al. .
4,148,411 4/1979 Hodge et al. .
4,150,764 4/1979 Anderson .
4,151,633 5/1979 Reese et al. .
4,169,326 10/1979 Reese et al. .
4,170,623 10/1979 Dubois et al. .
4,213,539 7/1980 Reuter .
4,216,862 8/1980 Daenen .
4,257,527 3/1981 Snyder et al. .
4,263,860 4/1981 Santoni .
4,279,357 7/1981 Robinson .
4,314,720 2/1982 Santoni .
4,325,492 4/1982 Kunze .
4,342,402 8/1982 Jungles .
4,351,539 9/1982 Rodolakis .
4,356,931 11/1982 Schinke .
4,394,966 7/1983 Snyder et al. .
4,401,312 8/1983 Parker .
4,407,427 10/1983 Reuter .
4,414,704 11/1983 Reuter .
4,420,105 12/1983 Nepper .
4,420,168 12/1983 Dewing .
4,422,814 12/1983 Borders .
4,445,623 5/1984 Kolling et al. .
4,448,327 5/1984 Gahm .
4,450,976 5/1984 Snyder et al. .
4,504,535 3/1985 Snyder .
4,512,700 4/1985 Santoni .
4,545,502 10/1985 Reuter .
4,558,799 12/1985 Hammond .
4,593,873 6/1986 Nelson .
4,595,112 6/1986 Dubois .
4,613,271 9/1986 Naab .
4,660,733 4/1987 Snyder et al. .
4,663,803 5/1987 Gora .
4,674,759 6/1987 Parker .
4,687,405 8/1987 Olney .
4,712,701 12/1987 Durkan, Jr. .
4,715,144 12/1987 Lee .
4,741,937 5/1988 Parker .
4,749,101 6/1988 Durkan, Jr. .
4,765,503 8/1988 Otto et al. .
4,785,964 11/1988 Miller et al. .
4,789,078 12/1988 Miller et al. .
4,819,827 4/1989 Disesa .
4,836,394 6/1989 Glomski .
4,848,028 7/1989 Johnson et al. .
4,852,792 8/1989 Hale .
4,878,592 11/1989 Lee .
4,907,715 3/1990 Bloomer .
4,930,649 6/1990 Moser .
4,951,833 8/1990 Carpenter, Jr. et al. .
4,967,924 11/1990 Murofushi et al. .
4,969,813 11/1990 Lee et al. .
4,971,241 11/1990 Wagers .
4,972,966 11/1990 Craft, Jr. .
5,141,124 8/1992 Smith et al. ..... 220/334

WASTE CONTAINER

BACKGROUND OF THE INVENTION

Field Of The Invention

This invention relates to waste containers, and more particularly to a waste container designed for use with a semiautomated or automated method of waste collection.

In the increasingly urban society of today, municipalities and other governmental entities must provide the basic services upon which such a ,modern society depends for living in a densely populated urban area. One such essential service is waste removal. The efficient and cost-effective removal of waste is both socially desirable and necessary for a well-run society.

Waste collection has historically been accomplished by a manual method. The typical manual method of waste collection operation involves a waste removal truck stopping at each curbside waste container. The waste removal truck is manned by a driver and one or more workmen who ride or walk along side the waste removal truck. Each waste container is manually lifted by the workman and is carried from the curb to the waste removal truck. The waste container is inverted over a waste bin of the waste removal truck thereby depositing the waste into the waste removal truck. The waste container is returned to the curb by the workmen.

It should be appreciated that the manual method of waste collection is a hard, a dirty and a labor intensive task. As labor costs rise, this manual method of waste collection becomes a less efficient and less desirable method. Because of the problems of manual waste collection, automated methods of waste collection were developed by the prior art. The automated methods of waste collection are either semi-automated methods or automated methods. Typically, the waste containers used in semi-automated methods or automated methods of waste collection are larger in size than conventional waste containers and are mounted on wheels.

In the semi-automated method of waste collection, a workman rolls the waste container from the curb and connects the waste container to a clamping mechanism on the waste removal truck. The clamping mechanism on the waste removal truck lifts and inverts the waste container to deposit the waste into the waste removal truck. The clamping mechanism on the truck lowers the waste container and returns the waste container to an upright position. The workman removes the waste container from the clamping mechanism on the waste removal truck and returns the waste container to the curb. Although the semi-automated method of waste collection provided an improvement over the manual method of waste collection, the semi-automated method of waste collection still suffers the disadvantage of requiring at least one workman for handling the waste container.

In the automated method of waste collection, there are no workmen required other than the waste removal truck driver. The driver positions the waste removal truck relative to the waste container and manipulates a control which operates a mechanical arm extending from the waste removal truck. The mechanical arm grasps the waste container, lifts and inverts the waste container over a waste bin to deposit the waste into the waste removal truck. The mechanical arm then lowers the waste container back to the ground and releases the grasp on the waste container. The driver then moves the waste removal truck to the next waste container and repeats the process.

The semi-automated and automated methods of waste collection have proven to be effective techniques for reducing labor costs and improving working conditions for municipal employees. Accordingly, many municipalities and other governmental entities have adopted either the semi-automated or the automated methods of waste collection.

While the automated method of waste collection is more efficient and offers other advantages over the manual and semiautomated method of waste collection, the automated method of waste collection has several problems. First, the mechanical grasping, lifting and inverting by the mechanical arm can be very damaging to the waste container. Frequently, the hinge mechanism and lid are the most vulnerable to damage. Replacing the damaged hinge or lid can be a time consuming and a costly undertaking.

Second, the waste containers that have been developed for use in an automated method of waste collection have a higher profile being larger, taller and narrower than conventional waste containers. The higher profile facilitates the grasping of the waste container by the mechanical arm of the waste removal truck. Unfortunately, the higher profile results in the waste container having a higher center of mass than a conventional waste container. The higher center of mass makes the waste container more unstable and more difficult to hold in balance when rolling in a balanced position on wheels. Accordingly, the higher profile waste container is more difficult for the homeowner to manipulate the waste container to the curb.

Therefore, it is an object of the present invention to provide an improved waste container for semi-automated and automated methods of waste collection that overcomes the problems of the prior art waste containers designed for semiautomated and automated methods of waste collection.

Another object of the present invention is to provide an improved waste container for semi-automated and automated methods of waste collection with an improved protected hinge mechanism.

Another object of the present invention is to provide an improved waste container for semi-automated and automated methods of waste collection with an easily replaceable lid.

Another object of the present invention is to provide an improved waste container for semi-automated and automated methods of waste collection with an improved lid support system.

Another object of the present invention is to provide an improved waste container for semi-automated and automated methods of waste collection with an improved lid that is supported when the lid is in an open position.

Another object of the present invention is to provide an improved waste container for semi-automated and automated methods of waste collection with a lower overall height that is easier to store than prior art waste containers designed for semi-automated and automated methods of waste collection.

Another object of the present invention is to provide an improved waste container for semi-automated and automated methods of waste collection with an improved profile having a lower center of mass than prior art waste containers designed for semi-automated and automated methods of waste collection.

Another object of the present invention is to provide an improved waste container for semi-automated and automated methods of waste collection that is easier to roll on wheels in a balanced position than prior art waste containers designed for semi-automated and automated methods of waste collection.

The foregoing has outlined some of the more pertinent objects of the present invention. These objects should be construed as merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved waste container comprising a container body including a bottom and a sidewall defining an opening in the container body. The container body has first and second handle support means extending outwardly from the container body with a handle extending between the first and second handle support means for supporting a handle. A first and a second aperture is defined in the first and second handle support means. A container lid has a lid rim for covering the opening in the container body with first and second lid support means extending outwardly from the container lid. A first and a second pin extend from the first and second lid support means, respectively. A hinge means comprising the first and second apertures of the first and second handle support means receiving the first and second pins of the first and second lid support means for pivotally connecting the container lid to the container body. A barrier means comprising the handle and the first and second lid support means limits the pivotal movement of the container lid about the hinge means.

In a more specific embodiment of the invention, the barrier means comprises the handle being mounted in a path of rotation of the first and second lid support means about the hinge means for limiting the pivotal movement of the container lid about the hinge means. Preferably, the barrier means comprises a first and a second handle planar surface mounted on the handle with the first and second lid support means having a first and a second lid support planer surface. The first and second lid support planer surface engage with the first and second handle planar surface in a common plane of contact for limiting the pivotal movement of the container lid about the hinge means. The container lid is pivotable between a closed position and an open position through a pivot angle greater than 90 degrees and less than 130 degrees.

In one embodiment of the invention, the first and second pins extend outwardly from the first and second lid support means in opposed directions along a common axis. The first and second apertures defined in the first and second handle support means face one another along a common axis with the first and second apertures receiving the first and second pins from a position between the first and second apertures. The first and second handle support means extend from the container body in a substantially parallel relationship. The handle extends between the first and second handle support means forming a substantially U-shape member. The first and second lid support means are mounted between the first and second handle support means for allowing the insertion of the first and second pins into the first and second apertures and for enabling the first and second handle support means to protect the first and second lid support means. Preferably, the first and second pins and the first and second apertures are aligned with each other along an axis substantially parallel to an axis of the handle.

The container lid is resiliently deformable to permit the first and second pins to enter the first and second apertures. The container body and the first and second handle support means and the handle may be integrally rotationally molded of a polymeric material. Similarly, the container lid and the first and second lid support means and first and second pins may be integrally rotationally molded of a polymeric material.

A pair of wheels are rotatably mounted on an axle relative to the container body for facilitating the movement of the waste container over a horizontal surface. The handle is mounted on the upper portion of the sidewall to extend above the pair of wheels for enabling the waste container to be balanced on the pair of wheels by an operator manipulating the handle.

Preferably, the sidewall of the container body tapers from a larger cross-sectional area at the annular rim to a smaller cross-sectional area at the bottom at an angle of substantially 3 degrees.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
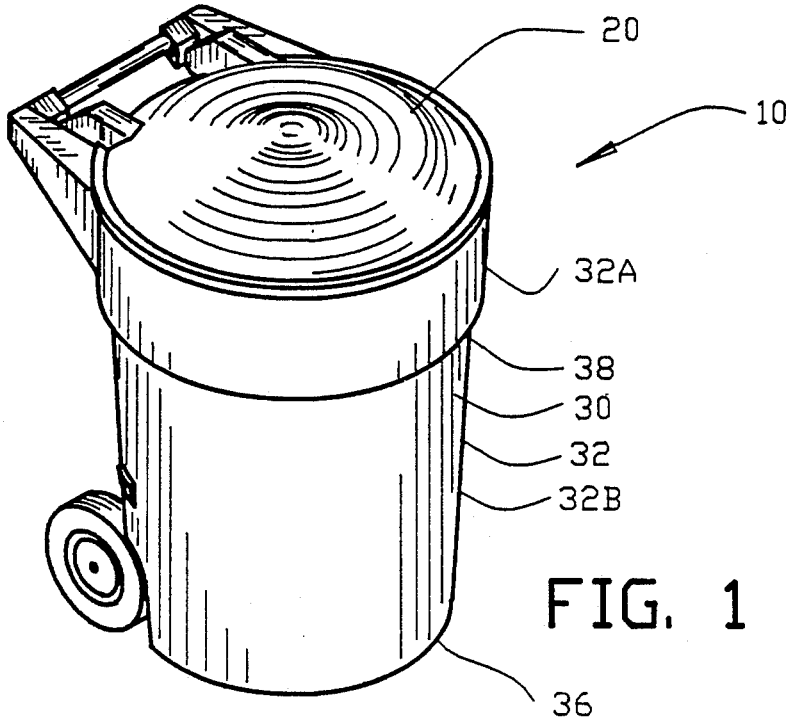
FIG. 1 is an isometric view of an improved waste container incorporating the present invention with the lid being disposed in a closed position.
Figure 2:
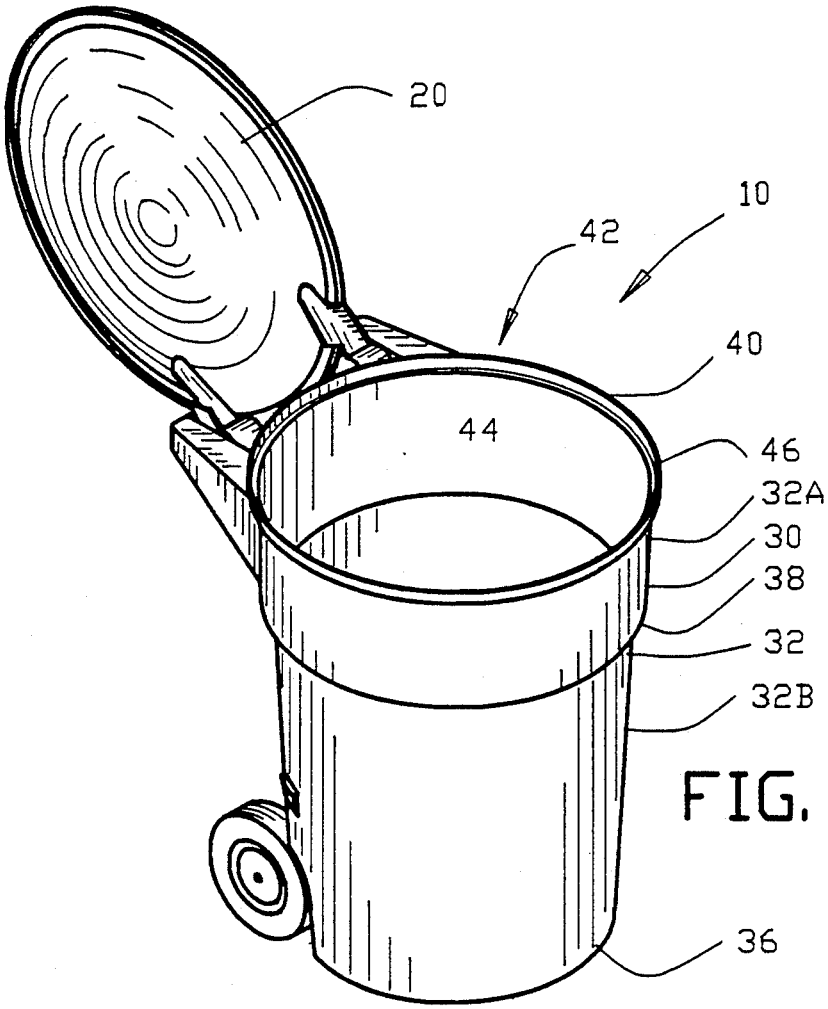
FIG. 2 is an isometric view of the improved waste container with the lid being disposed in an open position.
Figure 3:
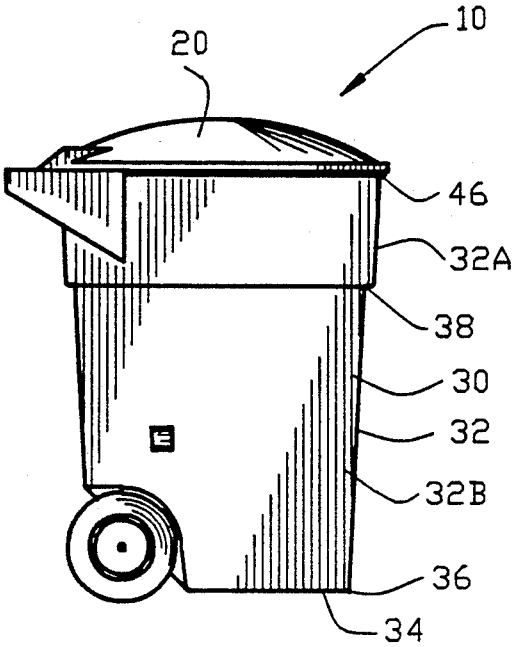
FIG. 3 is a side elevational view of the improved waste container with the lid being disposed in the closed position.
Figure 4:
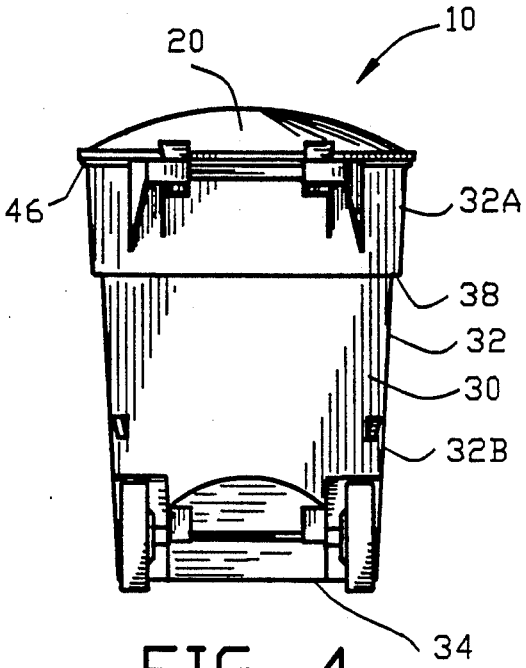
FIG. 4 is a rear elevational view of the improved waste container with the lid being disposed in the closed position.
Figure 5:
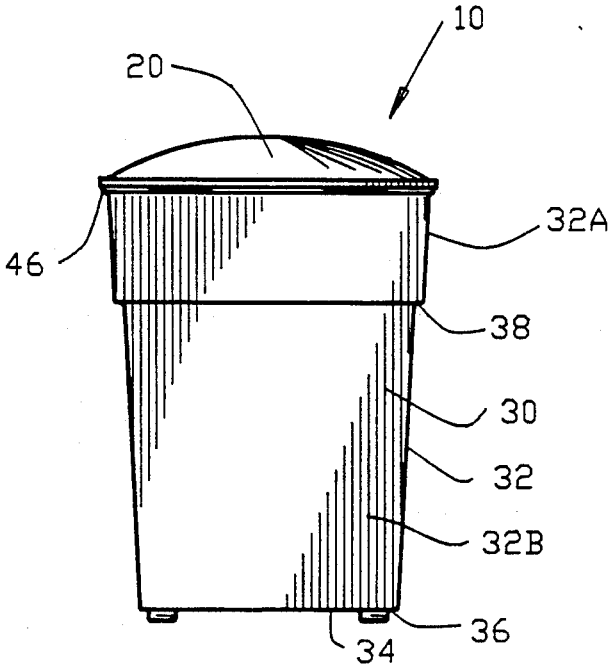
FIG. 5 is a front elevational view of the improved waste container with the lid being disposed in the closed position.
Figure 6:
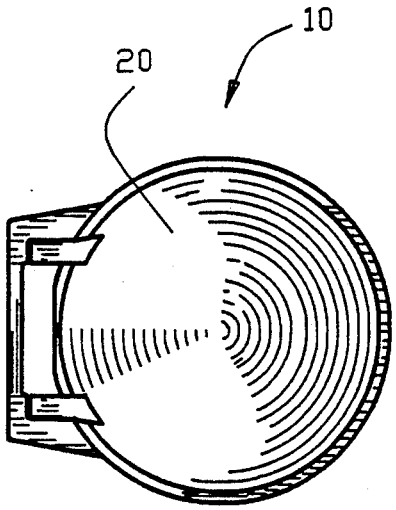
FIG. 6 is a top view of FIG. 3.
Figure 7:
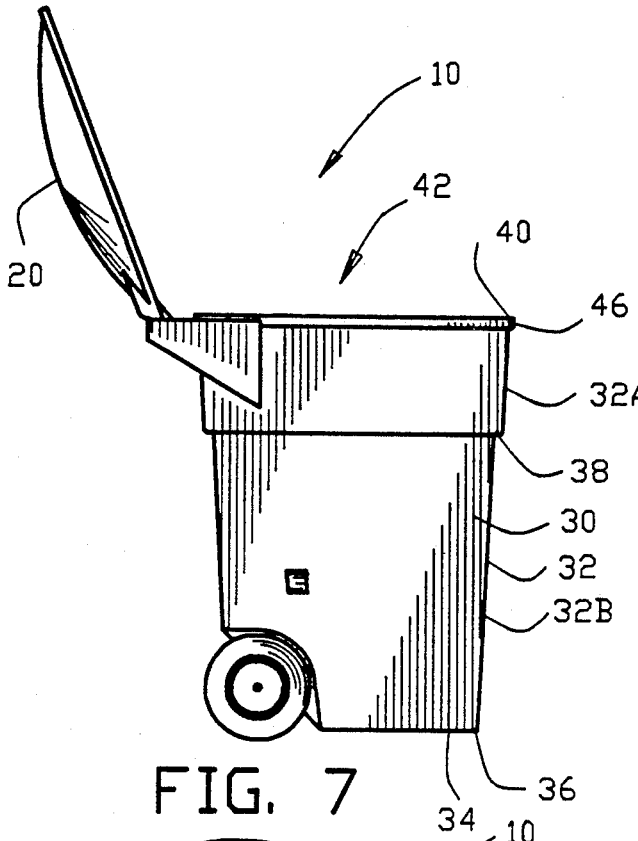
FIG. 7 is a side elevational view of the improved waste container with the lid being disposed in the open position.
Figure 8:
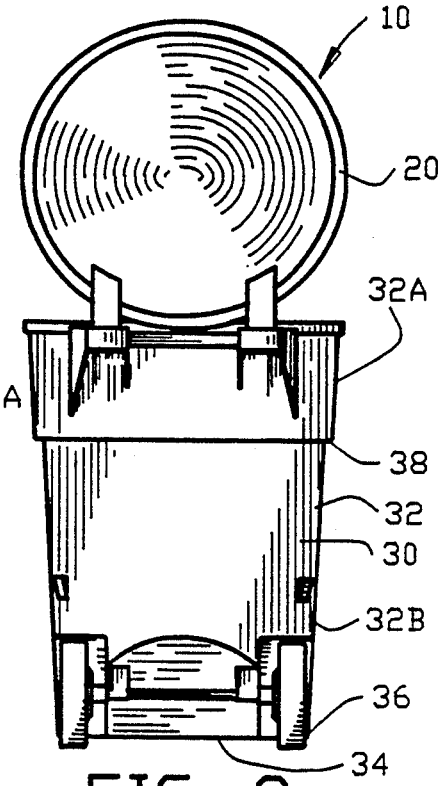
FIG. 8 is a rear elevational view of the improved waste container with the lid being disposed in the open position.
Figure 9:
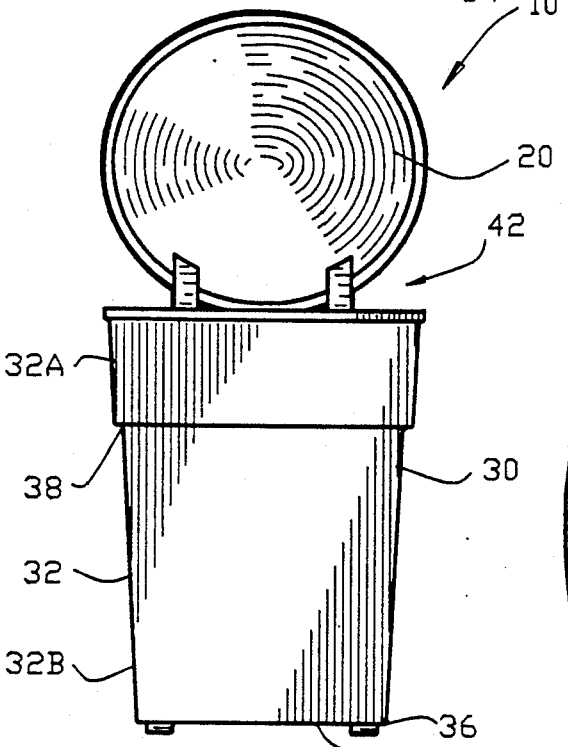
FIG. 9 is a front elevational view of the improved waste container with the lid being disposed in the open position.
Figure 10:
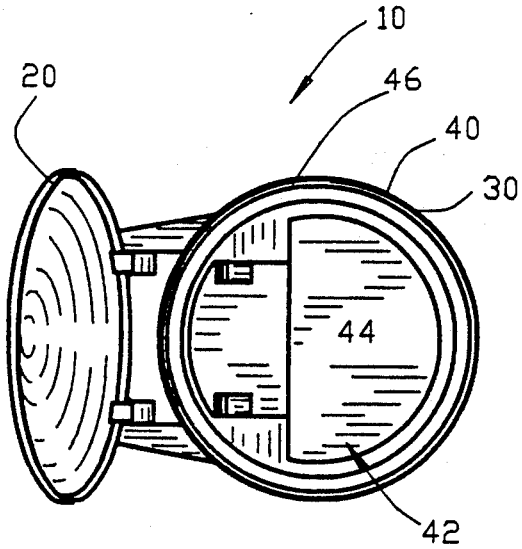
FIG. 10 is a top view of FIG. 7.

FIG. 1 is an isometric view of an improved waste container 10 incorporating the present invention with a container lid 20 being disposed in a closed position. FIG. 2 is an isometric view of the improved waste container 10 with the container lid 20 being disposed in an open position. FIGS. 3–6 illustrate various views of the improved waste container 10 with the container lid 20 being disposed in the closed position whereas FIGS. 7–10 illustrate various views of the improved waste container 10 with the container lid 20 being disposed in the open position.

The waste container 10 comprises a container body 30 having a sidewall 32 and a bottom 34 joined along a circular bottom perimeter 36. The bottom 34 of the waste container 10 is substantially planar for resting on a horizontal plane (not shown).

The sidewall 32 comprises a tapered upper portion 32A and a tapered lower portion 32B that are joined by a sidewall rib 38. The upper portion 32A of sidewall 32 has a substantially circular annular rim 40 that defines an opening 42 in container body 10 leading into a container interior 44. The container interior 44 is defined by the sidewall 32, the bottom 34 and an angular surface 40. Preferably, the container interior 44 has a large volume of substantially 90 gallons.

The annular rim 40 has a rim lip 46 protruding outwardly in the horizontal plane from the annular rim 40. The upper portion 32A of the sidewall 32 tapers from the annular rim 40 toward the sidewall rib 38 at an angle of substantially three degrees from a vertical. Similarly, the lower portion 32B of the sidewall 32 tapers from the sidewall rib 38 to the bottom 34 at an angle of substantially three degrees from the vertical.

Figure 11:
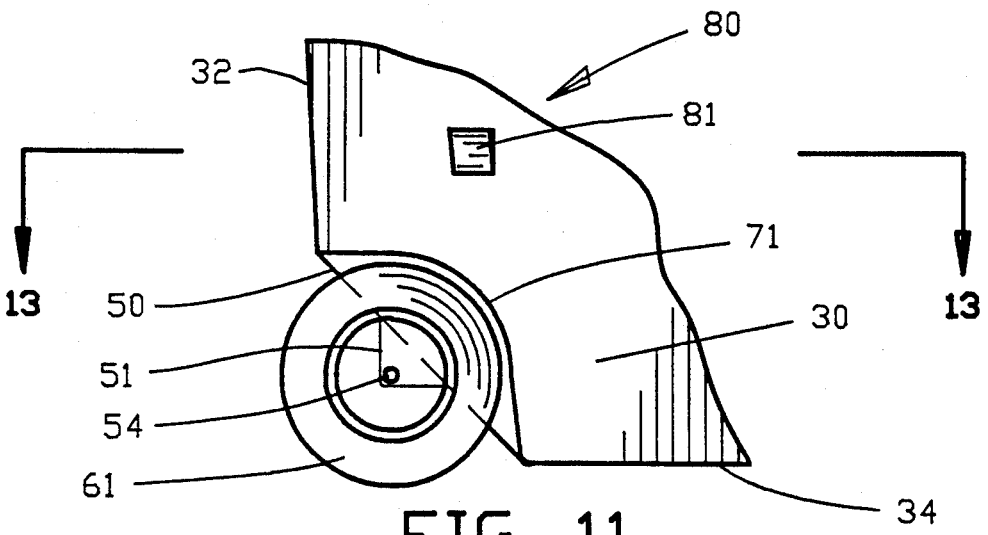
FIG. 11 is an enlarged view of a portion of FIG. 3.
Figure 12:
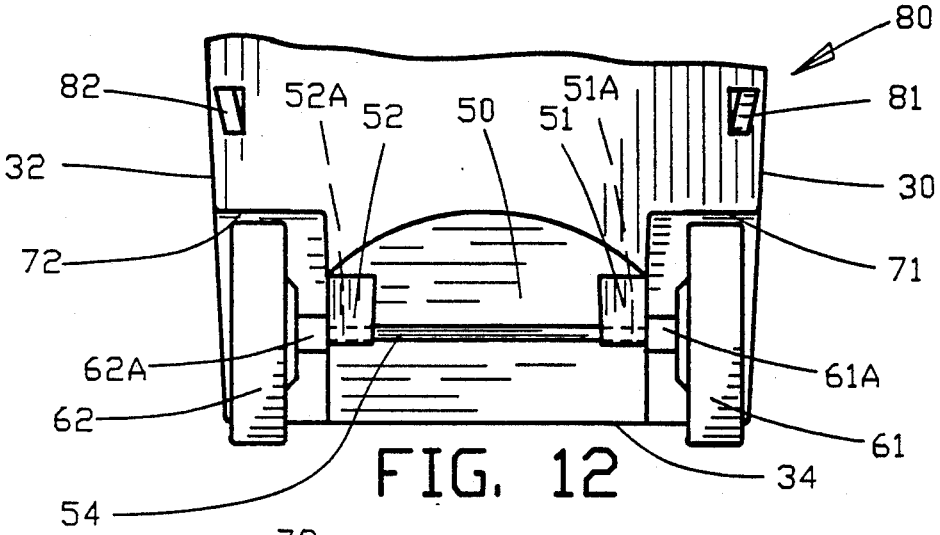
FIG. 12 is a rear view of FIG. 11.
Figure 13:
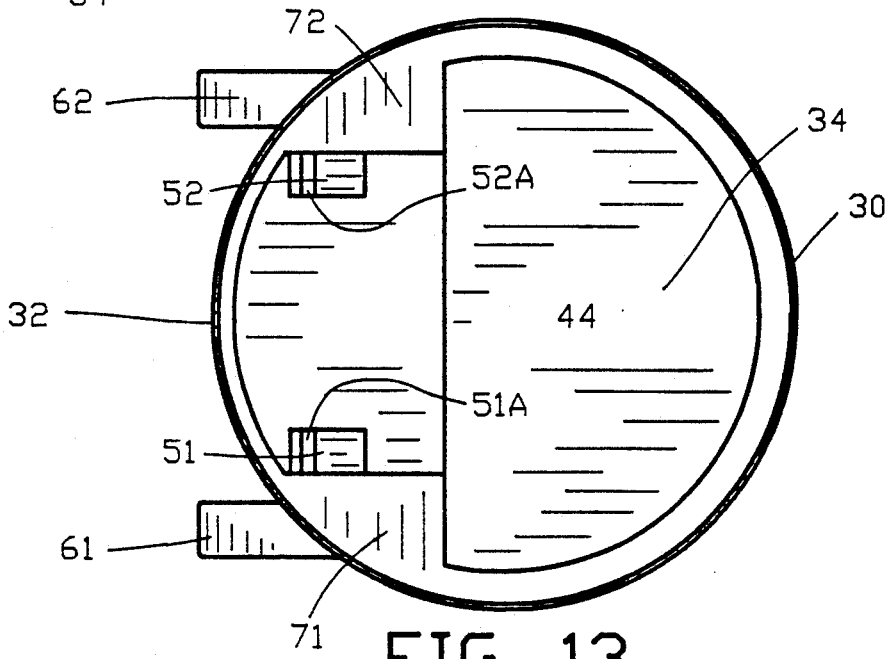
FIG. 13 is a view along line 13—13 in FIG. 11

As shown in FIGS. 11–13, an angular surface 50 is angularly joined with the sidewall 32 and bottom 34. The angular surface 50 is preferably planar but may be convex in shape, protruding slightly outwardly from the container body 10. A first and a second axle support 51 and 52 protrude outwardly from angular surface 50 in a triangular configuration. Preferably, the first and second axle supports 51 and 52 are integrally molded with the waste container 10 and open to container interior 44. The first and second axle supports 51 and 52 define two cylindrical holes 51A and 52A for receiving an axle 54 extending therethrough. The axle 54 rotatably mounts a first and a second wheel 61 and 62. The first and second wheels 61 and 62 are secured to the ends of the axle 54 by conventional mechanical fasteners. A first and a second spacer 61A and 62A space the first and second wheels 61 and 62 relative to the first and second axle supports 51 and 52, respectively.

A first and a second wheel indentation 71 and 72 are defined for receiving the first and second wheels 61 and 62. The first and second wheel indentations 71 and 72 are concave and protrude inwardly from the angular surface 50 and the sidewall 32. The first and second wheel indentations 71 and 72 are established such that the first and second wheels 61 and 62 do not extend beyond the sides of the container body 30 as shown in FIG. 12 but extend beyond the back of the container body 30 as shown in FIG. 13. Preferably, the first and second indentations 71 and 72 are integrally molded with the waste container 10.

Limiting means 80 include a first and a second projection 81 and 82 extend outwardly from the lower portion 32B of the sidewall 32. The first and second projections 81 and 82 are integrally molded with the waste container 10. The first and second projections 81 and 82 are spaced a sufficient distance, preferably 14 inches, from the sidewall rib 38 to allow a mechanical arm of the waste removal truck (not shown) to grasp the container body 30 between the sidewall rib 38 and the first and second projections 81 and 82. The sidewall rib 38 insures that the waste container 10 will not slip through the grasp of the mechanical arm when the waste container 10 is elevated in an upright position. The first and second projections 81 and 82 limit the vertical movement of waste container 10 to insure that the waste container 10 will not slip through the grasp of the mechanical arm when the waste container 10 is elevated in an inverted position.

Figure 14:
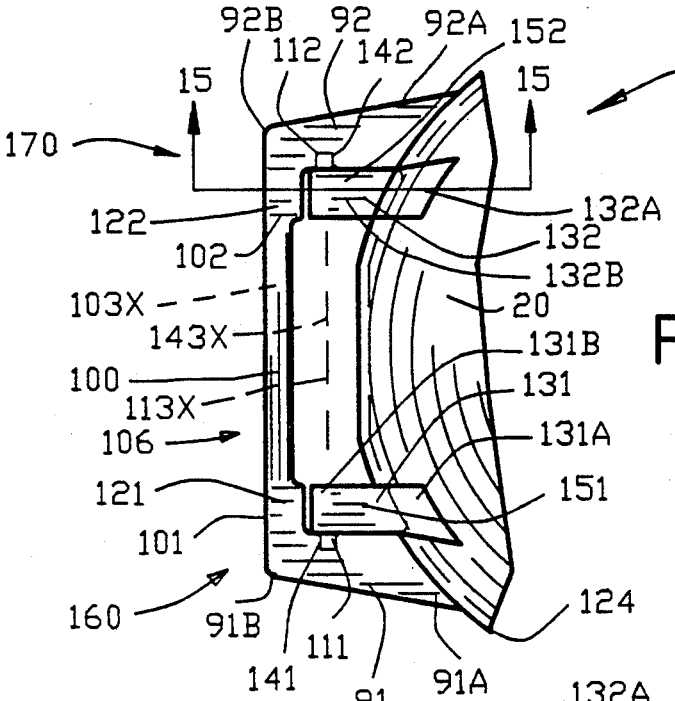
FIG. 14 is an enlarged view of a portion of FIG. 6.
Figure 15:
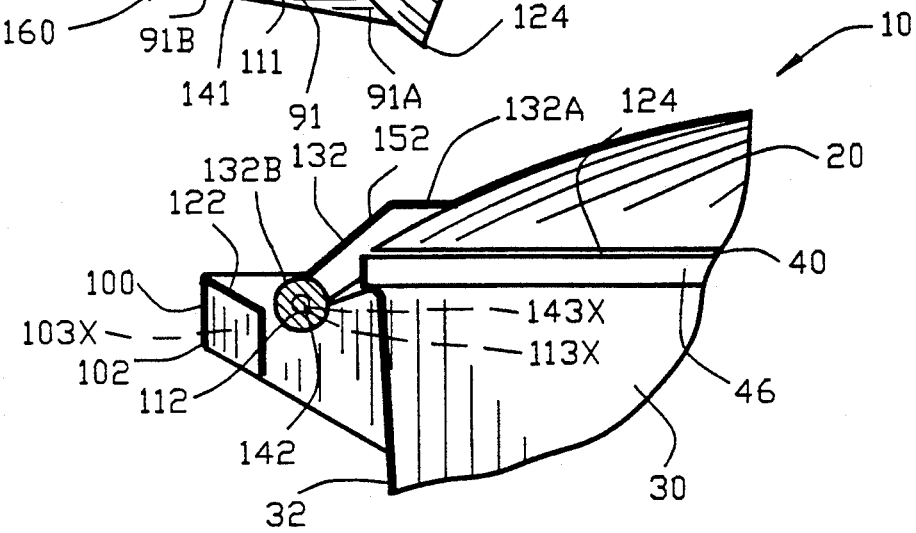
FIG. 15 is a sectional view along line 15—15 in FIG. 14.
Figure 16:
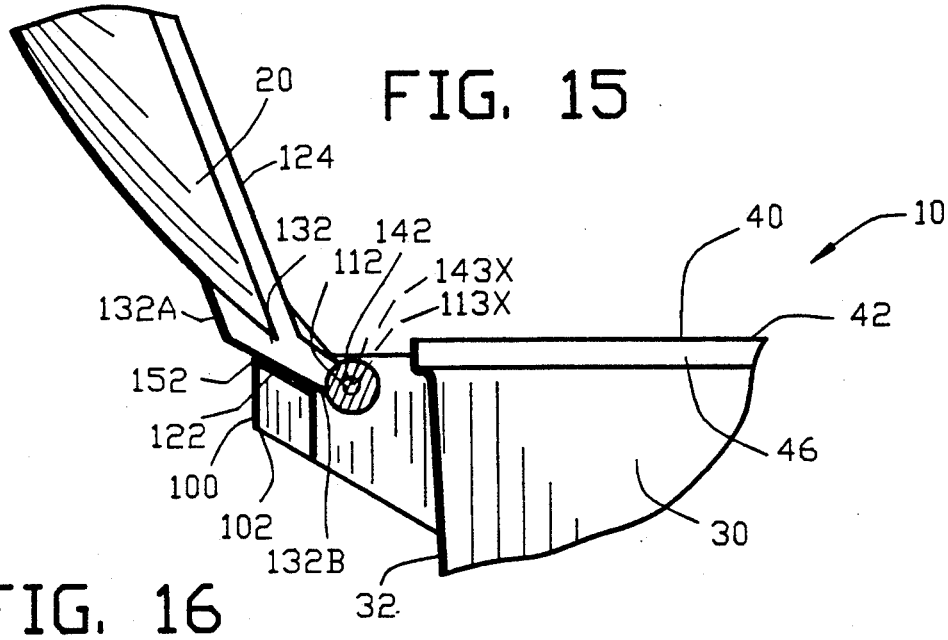
FIG. 16 is a sectional view similar to FIG. 15 illustrating the lid in the open position.

FIGS. 14–16 illustrate various enlarged partial views of the improved waste container 10 of the present invention. The improved waste container 10 includes a first and a second handle support 91 and 92 extending outwardly from the sidewall 32 proximate to the annular rim 40. The first and second handle supports 91 and 92 have proximal ends 91A and 92A and distal ends 91B and 92B, respectively. The proximal ends 91A and 92A are integrally molded with the sidewall 32 of the container body 30. A handle 100 has a first and a second end 101 and 102 that are attached to the distal ends 91B and 92B of the first and second handle supports 91 and 92. The handle 100 has a center line 103X. The first and second handle supports 91 and 92 are substantially parallel to one another and form an U-shape member 106 with the handle 100.

The first and second handle supports 91 and 92 define a first and a second aperture 111 and 112 located adjacent to the first and second distal ends 91B and 92B. The first and second apertures 111 and 112 face one another along a common center line 113X that is parallel to center line 103X of the handle 100.

The handle 100 includes a first and a second handle planar surface 121 and 122 mounted on the handle 100. Preferably, the first and second handle supports 91 and 92, the handle 100 and the first and second handle planar surfaces 121 and 122 are integrally molded with the waste container 10.

The container lid 20 includes a lid rim 124 that is substantially circular and slightly larger in diameter than the rim lip 46 of the container body 30 to cover the opening 42 in the waste container 10. The container lid 20 is fabricated of a resiliently deformable material.

A first and a second lid support 131 and 132 have proximal ends 131A and 132A and distal ends 131B and 132B with the proximal ends 131A and 132A being secured to the container lid 20. The first and second lid supports 131 and 132 extend outwardly in parallel relationship from the lid rim 124. A first and a second pin 141 and 142 extend outwardly from the distal ends 131B and 132B of the first and second lid supports 131 and 132, respectively. The first and second pins 141 and 142 extend outwardly from the first and second lid supports 131 and 132 in opposed directions along a common axis 143X. The first and second lid supports 131 and 132 include a first and a second lid support planer surface 151 and 152, respectively.

The first and second apertures 111 and 112 are adapted to receive the first and second pins 141 and 142 from a position between the first and second apertures 111 and 112 for defining hinge means 160 to pivotally connect the container lid 20 to the container body 30.

The first and second lid supports 131 and 132 are mounted between the first and second handle supports 91 and 92 to allow the insertion of the first and second pins 141 and 142 into the first and second apertures 111 and 112. When the first and second pins 141 and 142 are inserted into the first and second apertures 111 and 112, the common axis 143X of the first and second pins 141 and 142 are coincident with the center line 113X of the first and second apertures 111 and 112. The coincident common axis 143X and the center line 113X are also aligned to be substantially parallel to the center line 103X of the handle 100.

The first and second handle supports 91 and 92 are more massive, surround and extend further from container body 30 than the first and second lid supports 131 and 132. Accordingly, the U-shape member 106 formed by the first and second handle supports 91 and 92 and the handle 100 protect the first and second lid supports 131 and 132.

A barrier means, shown generally as 170, comprises the first and second lid support planer surfaces 151 and 152 engaging with the first and second handle planar surfaces 121 and 122 in a common plane of contact for limiting the pivotal movement of the container lid 20 about the hinge means 160.

FIG. 15 illustrates the container lid 20 in the closed position wherein the container lid 20 covers the opening 42 of the container body 30.

FIG. 16 illustrates the container lid 20 in the open position wherein the first and second lid support planer surfaces 151 and 152 engage with the first and second handle planar surfaces 121 and 122 in the common plane of contact. The pivot angle of the container lid 20 is greater than 90 degrees and less than 130 degrees and is preferably 110 to 115 degrees.

Figure 17:
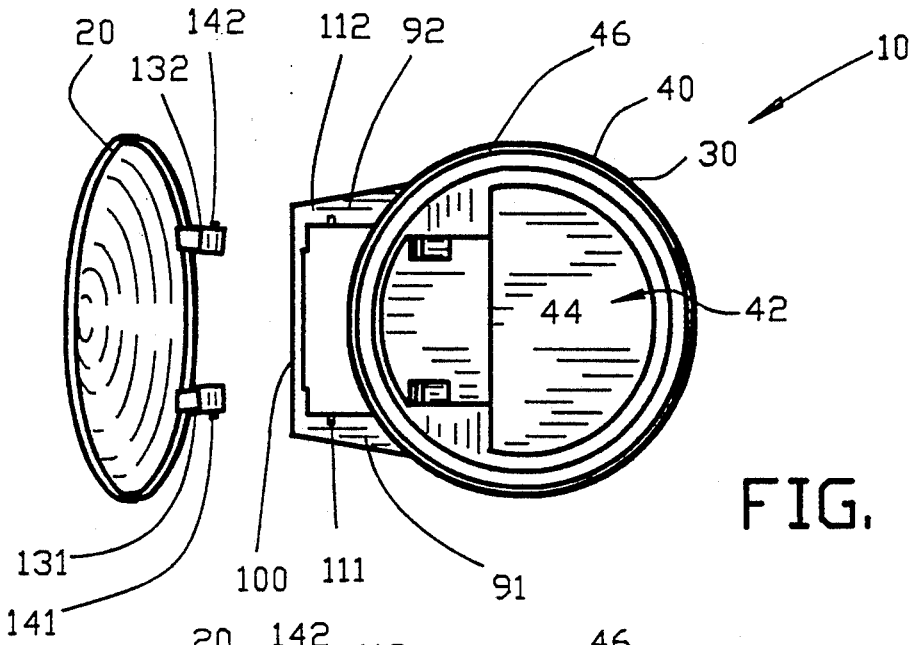
FIG. 17 is a view similar to FIG. 10 illustrating a bending of the lid separated from the container.

FIG. 17 illustrates a deformed container lid 20 separated from the container body 30. In the unlikely event that the container lid 20 is damaged, a new container lid 20 may be readily replaced without any tools or special skills. The container lid 20 is fabricated of a resiliently deformable material enabling an operator to deform the container lid 20 as shown in FIG. 17. The deformation of the container lid 20 angles the first and second lid supports 131 and 132 such that the first and second pins 141 and 142 no longer extend along the common axis 143X but are angled relative to one another.

Figure 18:
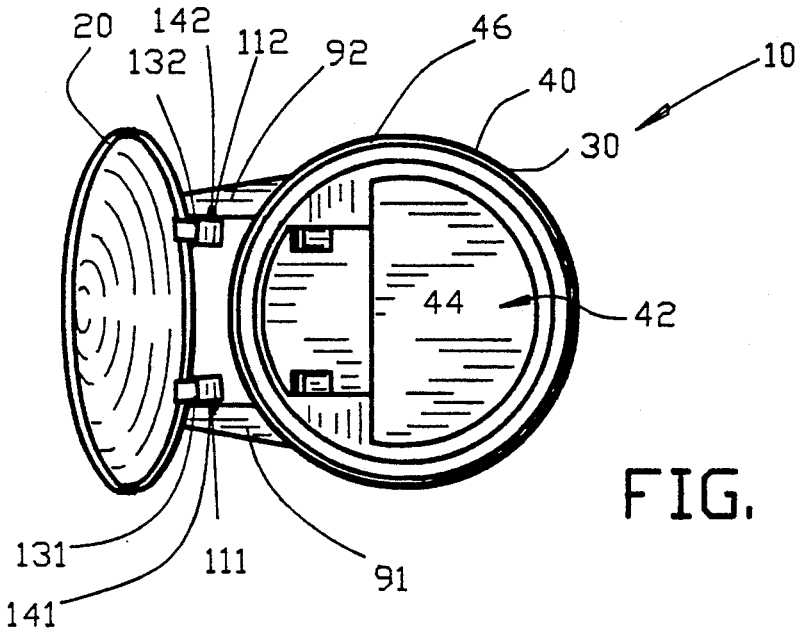
FIG. 18 is a view similar to FIG. 17 illustrating the bending of the lid while affixing the lid to the container.

FIG. 18 illustrates the deformed container lid 20 being affixed to the container body 30. The first and second pins 141 and 142 are angled relative to one another to facilitate the insertion of the first and second pins 141 and 142 into the first and second apertures 111 and 112. After the first and second pins 141 and 142 are partially inserted into the first and second apertures 111 and 112, the operator releases the deformation of the container lid 20.

Figure 19:
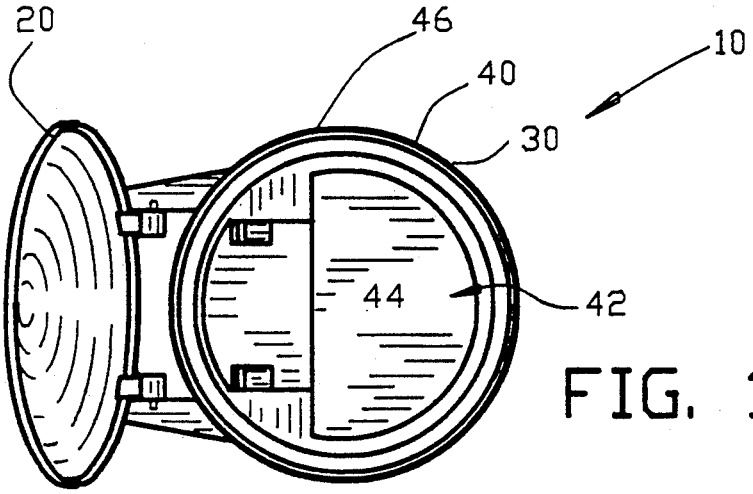
FIG. 19 is a view similar to FIG. 18 illustrating the lid affixed to the container.

FIG. 19 illustrates the deformed container lid 20 affixed to the container body 30 wherein the container lid 20 returns to the non-deformed position. When the container lid 20 returns to the non-deformed position, the first and second pins 141 and 142 are fully inserted into the first and second apertures 111 and 112. Accordingly, the problems of changing container lids encountered by the prior art are solved by the present invention.

Figure 20:
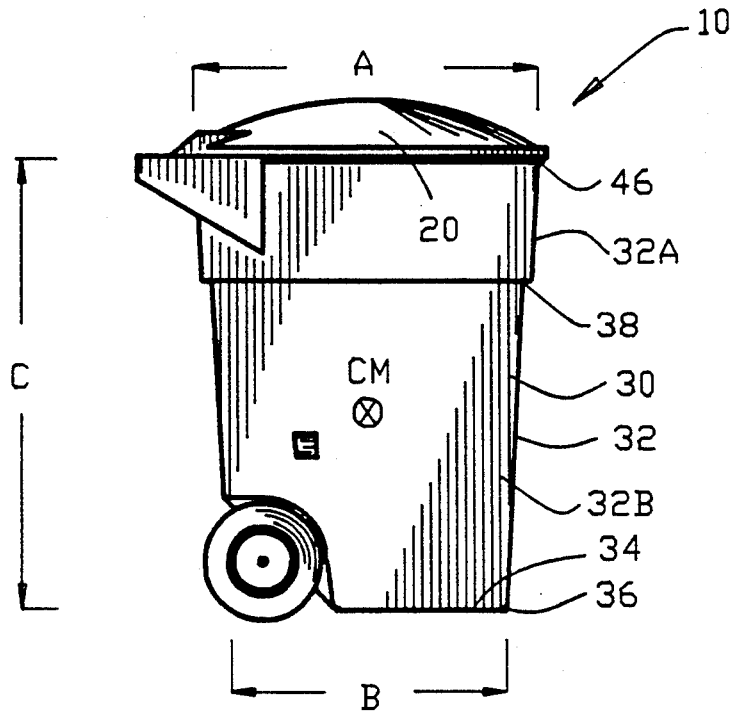
FIG. 20 is a side elevational view of the improved waste container in a normal position.

As shown in FIG. 20, the waste container 10 has an upper diameter A of 30.5 inches and a lower diameter B of 23.5 inches. The height C of the waste container 10 is 38.5 inches resulting in a capacity of approximately 90 gallons. The waste container 10 constructed in accordance with the above dimensions has a low profile defining a lower center of mass CM than other prior art containers designed for semi-automated or automated method of waste collection. The low profile of the waste container 10 of the present invention makes the waste container 10 easier to manipulate by older, frail, or physically infirm persons.

Figure 21:
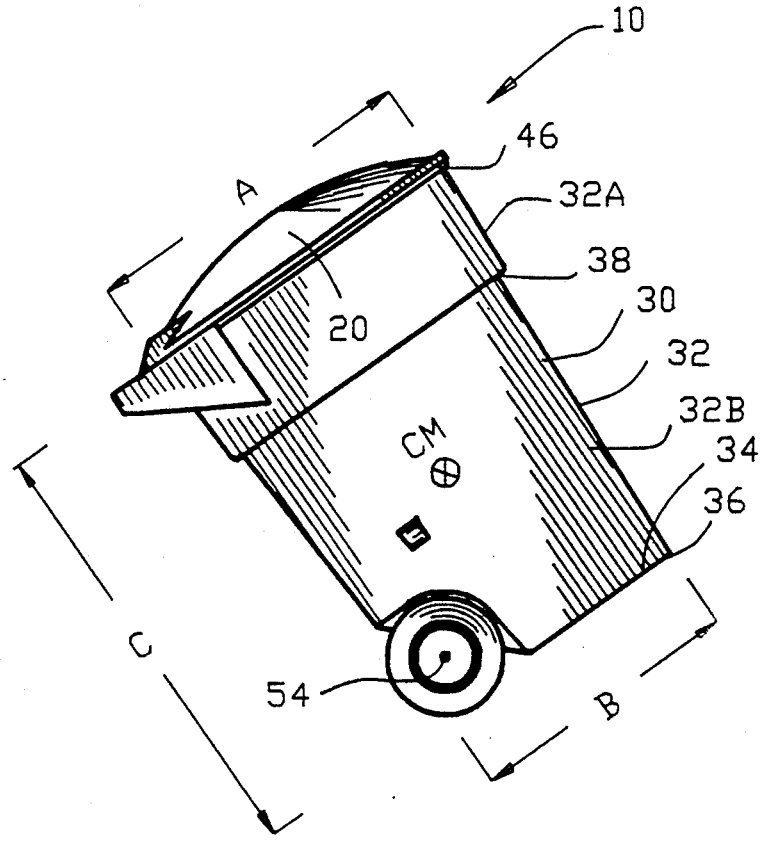
FIG. 21 is a view similar to FIG. 20 illustrating the improved waste container in a tilted position.

In order to move the waste container 10, it is necessary to tilt the waste container 10 about the axle 54 and balance the center of mass CM of the waste container 10 as shown in FIG. 21. The vertical position of the center of mass CM varies with the quantity of waste material present within the waste container 10. FIG. 21 illustrates the center of mass CM in the waste container 10 containing a typical amount of waste material. When the waste container 10 is tilted about the axle 54 to position the center of mass CM directly above the axle 54, the wheels 61 and 62 carry the full weight of the waste container 10. The positioning of the axle 54 and the handle 100 relative to the center of mass CM enables the waste container 10 to be directly above the axle 54 when the handle 100 is spaced a vertical distance above the ground that is substantially 27 to 29 inches.

Preferably, the waste container 10 is rotationally molded by a conventional rotational molding process. However, the entire waste container 10 can be fabricated by rotational molding only two units consisting of the container lid 20 and the container body 30. The first and second wheels 61 and 62 may be conventionally fabricated wheels or may be fabricated by a rotational molding process in a manner similar to the rotational molding of the container 10 and the lid 20. After the rotational molding process, the container lid 20 is inserted onto the container body 30 as heretofore described. Thereafter, the axle 54 is inserted through the two cylindrical holes 51A and 52A and the wheels are secured to the axle 54.

The U-shape member 106 formed by the first and second handle supports 91 and 92 and the handle 100 of the present invention provides several important advantages over the prior art. First, the U-shape member 106 encloses the first and second lid supports 131 and 132 and protects the first and second pins 141 and 142. Second, the U-shape member 106 provides the barrier means for limiting the pivotal movement of the container lid 20. Third, the U-shape member 106 allows the container lid 20 to be easily installed and replaced without any tools or special skills.

The low profile of the improved waste container 10 provides a more stable container while facilitating the movement thereof by older, frail, or physically infirm person. The low profile of the improved waste container 10 is more compact and easier to store.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved waste container, comprising:

a container body including a bottom and a sidewall with said sidewall having an annular rim defining an opening in said container body;

said container body having first and second handle support means extending outwardly from said container body;

a handle extending between said first and second handle support means for enabling the container to be grasped and manipulated by an operator;

a first and a second aperture defined in said first and second handle support means, respectively;

said first and second apertures being located between said handle and said container body;

a container lid having a lid rim for covering said opening in said container body;

first and second lid support means extending outwardly from said container lid;

a first and a second pin extending from said first and second lid support means, respectively;

hinge means comprising said first and second apertures of said first and second handle support means receiving said first and second pins of said first and second lid support means for pivotally connecting said container lid to said container body; and barrier means comprising said handle and said first and second lid support means for limiting the pivotal movement of said container lid about said hinge means upon said first and second lid support means engaging said handle.

2. An improved waste container as set forth in claim 1, wherein said barrier means comprises a first and a second handle planar surface mounted on said handle;

said first and second lid support means comprising a first and a second lid support planer surface; and said first and second lid support planer surfaces engaging with said first and second handle planar surfaces in a common plane of contact for limiting the pivotal movement of said container lid about said hinge means.

3. An improved waste container as set forth in claim 1, wherein said first and second pins extend outwardly from said first and second lid support means in opposed directions along a common axis;

said first and second apertures defined in said first and second handle support means facing one another along a common axis; and said first and second apertures receiving said first and second pins from a position between said first and second apertures.

4. An improved waste container as set forth in claim 1, wherein said first and second handle support means extend from said container body in a substantially parallel relationship;

said handle extending between said first and second handle support means forming a substantially U-shape member; and said first and second lid support means being mounted between said first and second handle support means for allowing the insertion of said first and second pins in said first and second apertures and for enabling said first and second handle support means to protect said first and second lid support means.

5. An improved waste container as set forth in claim 1, wherein said first and second pins and said first and second apertures are aligned with each other along an axis substantially parallel to an axis of said handle.

6. An improved waste container as set forth in claim 1, wherein said container lid is resiliently deformable to permit said first and second pins to enter said first and second apertures.

7. An improved waste container as set forth in claim 1, wherein said container body and said first and second handle support means and said handle being integrally molded; and said container lid and said first and second lid support means and first and second pins being integrally molded.

8. An improved waste container as set forth in claim 1, wherein said container body and said first and second handle support means and said handle being integrally rotationally molded of a polymeric material; and said container lid and said first and second lid support means and said first and second pins being integrally rotationally molded of a polymeric material.

9. An improved waste container as set forth in claim 1, wherein said container body further comprises limiting means disposed on said sidewall between said annular rim and said bottom for limiting vertical movement of the container when said container body is grasped by a mechanical arm.

10. An improved waste container as set forth in claim 1, including a pair of wheels rotatably mounted on said container body for facilitating the movement of the waste container over a horizontal surface.

11. An improved waste container as set forth in claim 1, including a pair of wheels rotatably mounted on said container body for facilitating the movement of the waste container over a horizontal surface; and said handle being mounted on the upper portion of said container body extending above said pair of wheels for enabling the waste container to be balanced on said pair of wheels by an operator manipulating said handle.

12. An improved waste container as set forth in claim 1, wherein said barrier means comprises a first and a second handle planar mounted on said handle;

said first and second lid support means comprising a first and a second lid support planer surface;

said first and second lid support planer surfaces engaging with said first and second handle planar surfaces in a common plane of contact for limiting the pivotal movement of said container lid about said hinge means;

said container lid being pivotable between a closed position and an open position through a pivot angle;

said container lid being in said closed position when said container lid is covering said opening and in contact with said annular rim of said container body;

said container lid being in said open position when said first and second lid support planar surfaces engage with said first and second handle planar surfaces in said common plane of contact; and said pivot angle of said container lid being greater than 90 degrees and less than 130 degrees.

13. An improved waste container as set forth in claim 12, wherein said pivot angle is substantially 110 degrees.

14. An improved waste container, comprising:

a container body including a bottom and a sidewall with said sidewall having an annular rim defining an opening in said container body;

said container body having first and second rigid handle support means extending outwardly from said container body;

a rigid handle extending between said first and second handle support means to form a substantially U-shape member for enabling the container to be grasped and manipulated by an operator;

a first and a second aperture defined in said first and second handle support means, respectively;

said first and a second apertures defined in said first and second handle support means facing one another along a common axis and being located between said handle and said container body;

a container lid having a rim for covering said opening in said container body;

first and second lid support means extending outwardly from said container lid;

a first and a second pin extending from said first and second lid support means, respectively;

said first and second pins extending outwardly from said first and second lid support means in opposed directions along a common axis;

hinge means comprising said first and second apertures of said first and second handle support means receiving said first and second pins of said first and second lid support means for pivotally connecting said container lid to said container body;

said first and second lid support means being located between said first and second handle support means for enabling said first and second rigid handle support means to protect said hinge means; and barrier means comprising said handle and said first and second lid support means for limiting the pivotal movement of said container lid about said hinge means upon said first and second lid support means engaging said handle.

15. An improved waste container as set forth in claim 14, wherein said barrier means comprises a first and a second handle planar surface mounted on said handle;

said first and second lid support means comprising a first and a second lid support planer surface; and said first and second lid support planer surfaces engaging with said first and second handle planar surfaces in a common plane of contact for limiting the pivotal movement of said container lid about said hinge means.

16. An improved waste container as set forth in claim 14, wherein said container lid is resiliently deformable to permit said first and second pins to enter said first and second apertures.

17. An improved waste container as set forth in claim 14, wherein said container body and said first and second handle support means and said handle being integrally molded; and said container lid and said first and second lid support means and first and second pins being integrally molded.

18. An improved waste container as set forth in claim 14, wherein said container body and said first and second handle support means and said handle being integrally rotationally molded of a polymeric material; and said container lid and said first and second lid support means and said first and second pins being integrally rotationally molded of a polymeric material.

19. An improved waste container as set forth in claim 14, wherein said container body further comprises limiting means disposed on said sidewall between said annular rim and said bottom for limiting vertical movement of the container when said container body is grasped by a mechanical arm.

20. An improved waste container as set forth in claim 14, including a pair of wheels rotatably mounted on said container body for facilitating the movement of the waste container over a horizontal surface.

21. An improved waste container as set forth in claim 14, including a pair of wheels rotatably mounted on said container body for facilitating the movement of the waste container over a horizontal surface; and said handle being mounted on the upper portion of said container body extending above said pair of wheels for enabling the waste container to be balanced on said pair of wheels by an operator manipulating said handle.

22. An improved waste container as set forth in claim 14, wherein said barrier means comprises a first and a second handle planar surface mounted on said handle;

said first and second lid support means comprising a first and a second lid support planar surface;

said first and second lid support planer surfaces engaging with said first and second handle planar surfaces in a common plane of contact for limiting the pivotal movement of said container lid about said hinge means;

said container lid being a pivotable between a closed position and an open position through a pivot angle;

said container lid being in said closed position when said container lid is covering said opening and in contact with said annular rim of said container body;

said container lid being in said open position when said first and second lid support planer surfaces engage with said first and second handle planar surfaces in said common plane of contact; and said pivot angle of said container lid being greater than 90 degrees and less than 130 degrees.

23. An improved waste container as set forth in claim 22, wherein said pivot angle is substantially 110 degrees.

* * * * *